US007795814B2

(12) United States Patent
Maya

(10) Patent No.: US 7,795,814 B2
(45) Date of Patent: Sep. 14, 2010

(54) INTERCONNECTION FEEDTHROUGHS FOR CERAMIC METAL HALIDE LAMPS

(75) Inventor: Jakob Maya, Brookline, MA (US)

(73) Assignee: Resat Corporation, Brookline, MA (US)

( * ) Notice: Subject to any disclaimer, the term of this patent is extended or adjusted under 35 U.S.C. 154(b) by 199 days.

(21) Appl. No.: 12/157,993

(22) Filed: Jun. 16, 2008

(65) Prior Publication Data

US 2009/0309497 A1 Dec. 17, 2009

(51) Int. Cl.
*H01J 17/16* (2006.01)

(52) U.S. Cl. ..... 313/634; 313/493

(58) Field of Classification Search ..... 313/634, 313/493, 623–625

See application file for complete search history.

(56) References Cited

U.S. PATENT DOCUMENTS

| | | | |
|---|---|---|---|
| 4,155,757 | A | 5/1979 | Hing |
| 4,808,882 | A | 2/1989 | Parker et al. |
| 4,910,432 | A | 3/1990 | Brown et al. |
| 5,099,174 | A | 3/1992 | Coxon et al. |
| 5,404,078 | A | 4/1995 | Bunk et al. |
| 5,424,609 | A | 6/1995 | Geven et al. |
| 6,139,386 | A | 10/2000 | Suzuki et al. |
| 6,750,611 | B2 | 6/2004 | Gubbels |
| 6,882,109 | B2 | 4/2005 | Nakano et al. |
| 7,122,953 | B2 | 10/2006 | Piena |
| 2004/0124776 | A1 | 7/2004 | Lorio et al. |
| 2004/0135510 | A1 | 7/2004 | Bewlay et al. |
| 2007/0001610 | A1 | 1/2007 | Bewlay et al. |
| 2007/0188100 | A1 | 8/2007 | Anami et al. |

OTHER PUBLICATIONS

Official Search Report and Written Opinion of the International Searching Authority in counterpart International Application No. PCT/US 09/03587 filed Jun. 16, 2009.

*Primary Examiner*—Vip Patel
(74) *Attorney, Agent, or Firm*—Jakob Maya

(57) ABSTRACT

An arc discharge metal halide lamp for providing visible light comprising an arc discharge vessel which has capillary tubes therein in at least one of which there is a first electrical feedthrough extending through an interior passageway to have an interior end of that electrode positioned in the discharge region opposite the other the interior passageway of the other capillary and an exterior end thereof positioned outside the outer end of that capillary tube but joined to a cermet portion inside that tube. In an intermediate stage of fabricating the lamp, a bonding material ring of limited diameter is provided at the end of the capillary tube about the exterior end. In a completed lamp, the first electrical feedthrough has limited extent joints where its components are joined and, alternatively or in addition, has a limited offset between its components at a joint between them.

16 Claims, 4 Drawing Sheets

INTERCONNECTION FEEDTHROUGHS FOR CERAMIC METAL HALIDE LAMPS

BACKGROUND

This invention relates to ceramic metal halide (CMH) lamps and the sealing technology of such lamps.

Often times one of the structural components in the electrical feedthroughs of such lamps is made of a cermet (ceramic-metal composite) material. Cermets have been known for a long time to provide acceptable solutions for the sealing of electrical feedthroughs to surrounding nonconductive materials. For example, cermet materials have been made as early as 1979 by mixing coarse refractory oxide granules with fine metallic powders, such as tungsten, nickel and molybdenum, to obtain suitable electrical conductivity therein and yet result in having thermal expansion coefficients compatible with ceramic materials. Typical ceramic materials used in CMH lamps are polycrystalline alumina (PCA), individual rare earth oxides or their mixtures and sapphire.

In later years, up to the early 1990's, details of making cermets with various particle size materials, their structural forms, and their initial use in ceramic metal halide lamps were described by various lamp developers, but they did not at that time result in a practical ceramic metal halide (CMH) lamp. Later, in the mid 1990's, the first commercially viable CMH lamp was introduced, and the performance of metal halide lamps got a big boost as a result since the color characteristics, the kind of chemistries used, and the efficacies obtained were far superior to the previous quartz metal halide lamp technology. While the initial lamps introduced had electrical feedthroughs with structures made of niobium (Nb), molybdenum (Mo) and tungsten (W) metals, at later times some CMH lamps were introduced using cermets in those structures. Much of the work attempted to either shorten the overall size of an extended plug structure, lower the cost of the materials used, increase reliability of the seal under high temperature conditions, or provide an alternative seal that would be more manufacturable, or some combination of these. Here, the term "feedthrough" will be used for the entire current carrying structure of metals and ceramics, and the term "electrode" will be used specifically for the very tip section of the electrical feedthrough that is in contact with the gas plasma and the discharge arc during lamp use.

As is well known, the extended plug structure of such lamps, as shown in FIG. 1, allows the temperature at the seal reached during lamp operation to be considerably lower than that reached using a non-extended plug structure. A lamp, 4, in that figure has a borosilicate glass envelope, 5, set in a conventional Edison-type metal base with lead wires 6 and 7 leading therefrom supported in the envelope by a glass flare 8 and a glass dimple 9. Lead wires 6 and 7 are connected to the leads, or electrical feedthroughs, of an arc discharge tube 10. The reason for this temperature improvement is that the extended plug construction positions the seal further from the electrode in the tube main chamber in which the arc discharge occurs during lamp operation, and where temperatures are greatest in the electrical feedthrough during such operation, as compared to the non-extended plug structure that has the seal relatively close to the electrode in the main chamber (essentially without a PCA capillary extension). This feature of relative remoteness enables the extended plug structure types of lamps to have a reasonable duration of lamp operations, or lamp lifetime, and so be commercially viable.

One of the electrical feedthrough structural arrangements available involves the use of cermets that have an expansion coefficient intermediary to those of the two materials used in the structures joined therewith (which materials are also used in formulating the cermet material)—most often polycrystalline alumina and molybdenum. Although the cermet material allows forming a successful hermetic seal between the electrical feedthrough, in which it is used as a structural component, and the PCA of the capillary tube thereabout in which it is positioned via the glass frit sealing material, the cermet material also tends to be fairly brittle and a difficult base on which to spot weld other structural components to it. Therefore, it is quite a task in manufacturing arc discharge tubes and the corresponding lamps to handle the ends of electrical feedthroughs as arc tube electrical leads with a cermet piece as part of them sticking out of the PCA capillary to be exposed to the various risks and stresses of the manufacturing process.

The extended plug structure arc discharge lamp arrangement in present use that avoids having any cermet portion in the electrical feedthrough being exposed to the exterior of the arc discharge tube is shown in the cross section view in FIG. 1A of arc discharge tube 10 from FIG. 1. This is an arc discharge tube for a 150 W ceramic metal halide lamp 5 and, as indicated, is formed with an extended plug structure. Here arc discharge tube 10 includes a cylindrical main tube portion 15 smoothly joined with tapered capillaries portions 11*a* and 11*b*. Main tube portion 15, as well as the capillary parts 11*a* and 11*b* of the arc tube, are typically made of translucent ceramic material in which alumina is a main component.

A partially externally exposed outer lead wire, or sealing member 16*a*, a first lead-through wire 19*a*, and a first main electrode shaft 21*a* are joined together to form an electrical feedthrough that is positioned in capillary part 11*a*. In this arrangement, lead-through wire 19*a* is of a cermet material and sealing member 16*a* is a niobium material rod. A material typically used for electrode shaft 21*a* is tungsten or molybdenum. Specifically, one end of lead-through wire 19*a* is connected with one end of sealing member 16*a* by welding, and the other end of lead-through wire 19*a* is connected with one end of main electrode shaft 21*a* again by welding. Sealing member 16*a* is fixed to the inner surface of capillary part 11*a* by a glass frit 17*a* such that sealing member 16*a* is sealed hermetically to capillary part 11*a*. Sealing member, or outer lead wire, 16*a* is typically formed by niobium wire of a diameter compatible with the expansion coefficient of frit 17*a*. For example, the diameter of a niobium outer lead wire 16*a* may be 0.9 mm and the diameter of a molybdenum first main electrode shaft may be 0.5 mm.

Sealing member or outer lead wire 16*a*, first lead-through wire 19*a* and first main electrode shaft 21*a* are disposed, as indicated, in the capillary part 11*a* such that an end portion of outer lead wire 16*a* is positioned outside capillary part 11*a*. As can be seen in the figure, however, niobium outer lead wire 16*a* is positioned with the inner end thereof deep into capillary part 11*a* so that only a small thickness of frit 17*a* covers that inner end thereof. Thus, the repeated heating and cooling of arc tube 10 between the lamp being operated and not operated at some point tends to lead to cracks in frit 17*a*. Such cracks need not go far before outer lead wire 16*a* is exposed to the salts developed in the main discharge chamber during lamp operation which are very destructive of niobium material. Thus, this structural arrangement has a substantial risk of failure.

An electrode coil 22*a* is joined to the tip portion of main electrode shaft 21*a* by welding, so that main electrode 23*a* includes main electrode shaft 21*a* and electrode coil 22*a*. The electrode coil 22*a* is made out of tungsten or doped tungsten. The lead-through wire 19*a* serves as a lead-through to assure the placement of main electrode 23*a* at a predetermined position in main tube 15.

An alternative to the FIG. 1A electrical feedthrough structure is shown in FIG. 2 where a cross section view of one side of a PCA capillary part is shown. Here, instead of attaching cermet lead-through 19*a* directly to the tungsten main shaft 21*as* in FIG. 1A, a molybdenum mandrel 12 with a fine molybdenum coil 13 surrounding it is inserted between a cermet lead-through 25 and tungsten main shaft 21*a*. The advantage of this structural arrangement is that the salts formed in the discharge chamber during lamp operation do not penetrate as far into the end of the capillary, and therefore they are not as cold to thereby yield a reasonable performance of the lamp. In addition, the combination of the molybdenum mandrel and coil is compatible with the expansion/contraction of the capillary PCA so as not to lead to cracking thereof.

Also shown in FIG. 2 is the use of a stopping cross wire 29*a* that is welded to an outer wire 29 to limit the insertion distance of the electrical feedthrough through the capillary part into the arc discharge tube to assure that the feedthrough does not get outer lead wire 16*a* too near the main discharge chamber and that electrode 22 is properly spaced with respect to its counterpart feedthrough positioned on the opposite side of the main discharge chamber. This is a costly added step to accomplish in the difficult welding situation presented due to the previous nearby weld of outer wire 29 to cermet lead-through 25.

Another alternative (not shown) is to use a crimping operation to widen the cross section of the outer lead wire along a laterally directed cross axis thereof which is provided right at the junction of the cermet lead-through and the outer lead wire weld. Such a widened cross section crimp preventing further insertion of the electrical feedthrough into the capillary part results in accomplishing a similar result in setting the feedthrough insertion depth into the arc discharge tube through a capillary thereof as does the provision instead of a cross wire as describe above. However, the crimping process often leads to geometric distortion of the remaining wire such as bending or twisting it into misalignment with the feedthroughs axis of the lamp. This leads to a relatively large failure rate in the remaining lamp manufacturing process steps which significantly increases manufacturing costs. Therefore, an accurate crimp at the joint of these two materials is a difficult to impractical approach for low cost manufacturing of CMH lamps.

As indicated above, cermets do provide a good solution for structural use as part of an electrically conductive feedthrough in having a thermal expansion that is compatible with surrounding structures in CMH lamps; however, as also indicated above, the brittleness of the cermets and the difficulty of spot welding to them makes using cermet structure portions a difficult choice in manufacturing such feedthroughs. Thus, there is a desire for an electrical feedthrough structure better suited to the use of cermet portions therein.

SUMMARY

The present invention provides an intermediate arrangement for an arc discharge metal halide lamp for providing visible light comprising an arc discharge vessel formed of a visible light transmissive structure which defines a discharge region containing ionizable materials including a metal halide material and which has capillary tubes therein having a selected tube outside width between outside tube surface locations on opposite sides thereof and with a first electrical feedthrough positioned to extend through an interior passageway from a tube outer end in a corresponding one of the capillary tubes to have an interior end of that electrical feedthrough positioned in the discharge region opposite the interior passageway of the other capillary tube and an exterior end thereof positioned outside the outer end of the corresponding capillary tube, the interior passageway having a selected tube inside width between inside interior passageway surface locations on opposite sides thereof. The first electrical feedthrough having a cermet material portion thereof affixed to an end of an exterior electrical conductor portion thereof with a selected exterior conductor outside width between outside exterior electrical conductor surface locations on opposite sides thereof that is less than the tube outside width but greater than the tube inside width. A bonding material closed loop positioned about the end of the exterior electrical conductor portion such that the bonding material closed loop has no portion thereof extending past the outside tube surface locations of the corresponding capillary tube by more than thirty-five percent of the tube outside width.

The present invention also provides an arc discharge metal halide lamp for providing visible light comprising an arc discharge vessel formed of a visible light transmissive structure which defines a discharge region containing ionizable materials including a metal halide material and which has capillary tubes therein having a selected tube outside width between outside tube surface locations on opposite sides thereof and with a first electrical feedthrough positioned to extend through an interior passageway from a tube outer end in a corresponding one of the capillary tubes to have an interior end of that electrical feedthrough positioned in the discharge region opposite the interior passageway of the other capillary tube and an exterior end thereof positioned outside the outer end of the corresponding capillary tube. The first electrical feedthrough has a cermet material portion thereof, which has a selected cermet outside width between outside cermet material portion surface locations on opposite sides thereof, that is affixed in an outer fixation joint to an end of an exterior electrical conductor portion thereof along an axis common to each and that is also affixed in an inner fixation joint to an inner shaft electrical conductor portion along the common axis that also intersects the inner shaft electrical conductor portion, the inner shaft electrical conductor portion of the first electrical feedthrough having a selected inner shaft outside width between outside inner shaft electrical conductor portion surface locations on opposite sides thereof, the outer fixation joint having a length along the common axis between a nearest outside exterior electrical conductor portion surface and a nearest outside cermet material portion surface of a value that, doubled, is less than one-tenth the value of the length between the first fixation joint at the exterior electrical conductor portion side thereof and the interior end of the first electrical feedthrough in the circumstance of the inner shaft outside width having a magnitude with a value between the magnitude of the cermet outside width and one-half that magnitude thereof. Alternatively, or in addition, the first electrical feedthrough having a cermet material portion thereof extending along a cermet axis of symmetry with this cermet material portion having a selected cermet outside width between outside cermet material portion surface locations on opposite sides thereof, the cermet material portion being affixed in an inner fixation joint to an inner shaft electrical conductor portion extending along a shaft axis of symmetry substantially parallel to the cermet axis with the inner shaft electrical conductor portion having a selected inner shaft outside width between outside inner shaft electrical conductor portion surface locations on opposite sides thereof, the shaft axis on a corresponding side of the inner fixation joint being offset from the cermet axis on a corresponding side of the inner fixation joint by a distance having a magnitude with a value less than one-quarter that of the inner shaft outside width in the circumstance of the inner shaft outside width having a magnitude with a value less than one-half that of the cermet outside width.

DETAILED DESCRIPTION

Figure 1:
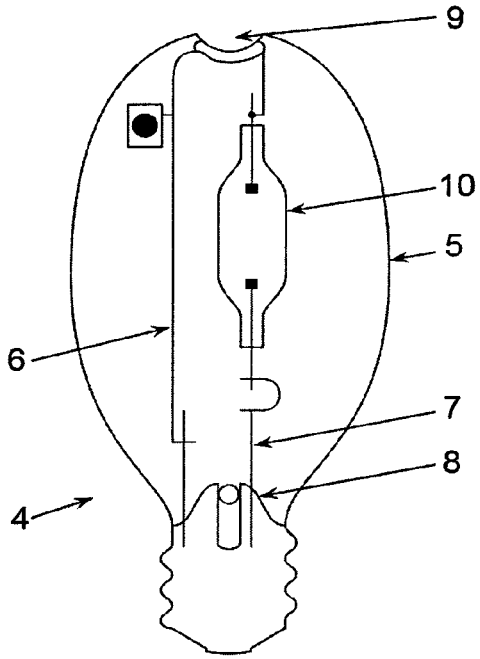
FIG. 1 is a cross section view of a conventional CMH lamp.

The current invention provides an electrical feedthrough suited to have a cermet material portion used therein. In the cross section view of apportion of an electrical feedthrough shown in FIG. 3, a cermet material lead-through 34 is shown connected to a conductive outer wire 35 having a diameter that is larger than the diameter of cermet lead-through 34, but smaller than the outer diameter of the associated arc tube capillary part 36. In this figure, a Mo coil 33 takes up some of the interior volume in the capillary part in a flexible fashion so as to prevent the salts from entering too far into the capillary part to there become too cooled. In addition, a glass frit ring 37 is shown surrounding the bottom of outer wire 35 and supported on the portion of the end of capillary part 36 remaining exposed after outer wire 35 is positioned thereon.

Figure 3:
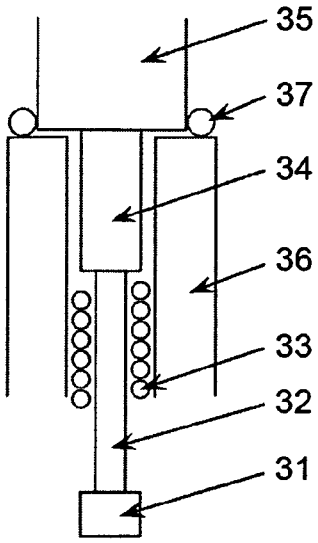
FIG. 3 is a cross section view of an electrical feedthrough embodying the present invention.
Figure 4:
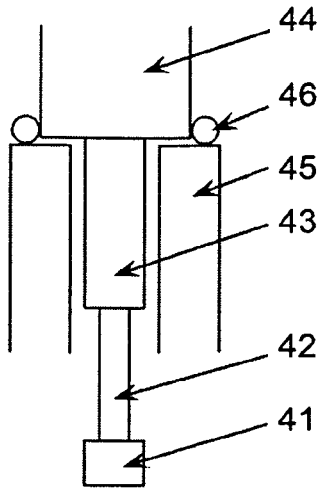
FIG. 4 is a cross section view of an intermediate arrangement used in providing the electrical feedthrough embodying the present invention.
Figure 4A:
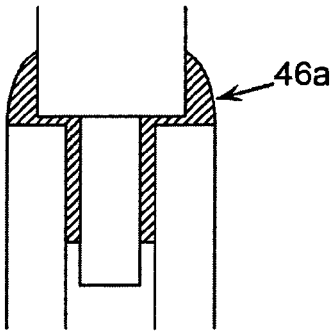
FIG. 4A is a cross section view of a resulting electrical feedthrough based on the arrangement of FIG. 4.
Figure 4B:
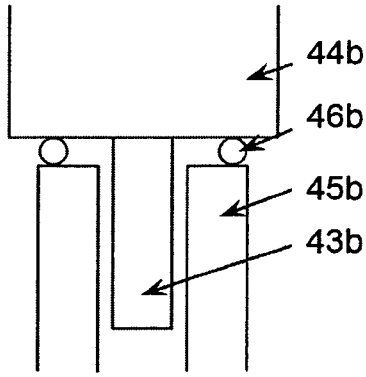
FIG. 4B is a cross section view of an ineffective electrical feedthrough intermediate arrangement due to relative geometrical factors.
Figure 4C:
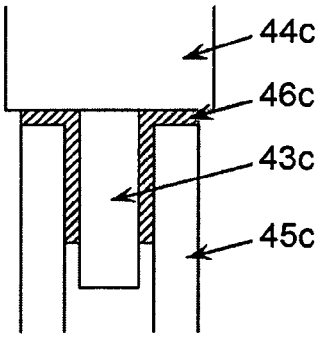
FIG. 4C is a cross section view of a resulting electrical feedthrough based on the arrangement of FIG. 4B.

Similarly, in FIG. 4 where the Mo coil 33 of FIG. 3 has been omitted, an outer wire 44 has a diameter that is larger than the diameter of a cermet lead-through 43 to which it is affixed, and that is smaller than the outer diameter of the arc tube capillary part 45. If the diameter of outer wire 44 is larger than the outer diameter of the capillary part 45 (the situation shown in FIG. 4B before a frit ring 46*b* between outer wire 44*b* and the end of capillary part 45*b* is melted in completing the construction of the feedthrough), then, after frit ring 46*b* melts (the result of which is shown in FIG. 4C), the seal obtained as a result from such melted glass frit is typically not very strong since the subsequently solidified frit does not cover a portion of the outer sides of outer wire 44*b* as it covers the outer sides of outer wire 44 in FIG. 4A.

Therefore, it is desirable to have outer lead wire 44 and frit ring 46 with the relative diameters as shown in FIG. 4 in attaching wire 44 to cermet lead-through 43. That is, outer wire 44 should be slightly larger than the internal diameter of capillary part 45 and slightly smaller than the external diameter of that capillary part in such a manner it can accommodate frit ring 46 sized to surround the lower end of outer wire 44 while being positioned on top of exposed portion of the end of capillary part 45 as shown in FIG. 4.

Figure 4D:
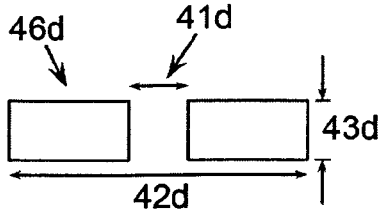
FIG. 4D is a cross section view of a bonding structure used in the intermediate arrangement of FIG. 4.

Thus, internal diameter 41*d* of frit ring 46, shown in the cross section view thereof in FIG. 4D, should be slightly larger than the diameter of outer wire 44 in FIG. 4, and the outer diameter 42*d* of that ring should be about the same size as the outer diameter of the PCA capillary part 45 in FIG. 4. If diameter 42*d* is considerably larger than the outer diameter of capillary part 45 in FIG. 4, part of the frit when melted flows over the end and onto the outside of the capillary 45, and this leads to a number of problems during the remaining part of the lamp manufacturing process which will then adversely affect lamp operational life. A suitable upper limit for the extent of diameter 42*d* is 35% greater than the outer diameter of the PCA capillary 45. In other words, if outer diameter 42*d* of frit ring 46 is designated FRod and the outer diameter of capillary part 45 is designated Cod, then satisfying the following inequality $$FRod \leqq 1.35Cod \qquad \text{Eq. 1}$$

will result in good seals. Failure to follow this inequality leads to manufacturing problems for such a CMH product often diminishing the lamp operational life. These problems can include insufficient frit flowing inside the capillary and therefore providing a poor seal and external frit drops just outside the capillary leading to different thermal profiles for capillaries which will lead to poor performance of the lamps.

Figure 5:
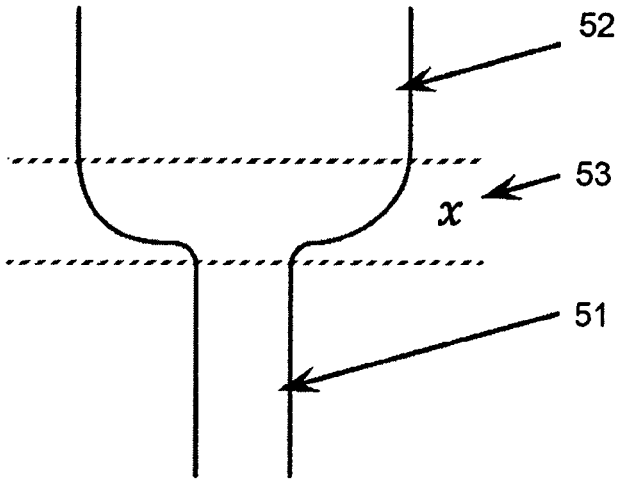
FIG. 5 is a cross section view of a portion of an electrical feedthrough embodying the present invention.

In the electrical feedthrough arrangements of FIGS. 3 through 6, there are several other aspects shown which typically can influence the performance of the lamp. One of these aspects is that there is a transition region of axial length x as shown in FIG. 5, designated 53. In this figure, 52 marks the outer wire (usually made out of Nb) and 51 marks the lead-through cermet material portion. If this region is not controlled in length along the longitudinal axis of symmetry of the electrical feedthrough carefully, it affects the arc length in the main discharge chamber and thereby affects the voltage drop across the lamp during lamp operation and so the performance of the lamp. The voltage across the lamp, V, during operation is determined by the arc length between the two electrical feedthroughs therein which length is shortened by increases in the transition regions lengths x of the two feedthroughs, and by the amount of Hg and salt provided in the arc tube during manufacture thereof. This lamp voltage drop in turn affects the lamp current in maintaining a constant wattage ballast by increasing the current required for smaller voltages to achieve that wattage. This lamp current in turn affects the ohmic heating of the W electrodes to thereby raise temperatures thereof for increased lamp current which in turn affects the salts vapor pressures and thereby the performance of the lamps.

This feedthrough transition region typically can be as much as 0.5 mm in length which, in a small power CMH lamp dissipating on the order of 20 W or 35 W, is a substantial fraction of the typical arc length (the transition region axial length has to be multiplied by 2 in subtracting from the arc length, since there is one transition region for each electrical feedthrough in the arc discharge tube). Variance in this transition region length in the manufacturing process leads to substantial performance variation in the resulting lamps. Therefore, to have a narrow distribution of lamp performances, the transition region length x of the feedthrough region 53 has to be minimized and controlled carefully. That is, the length x has to be reproducible in the manufacture of electrical feedthroughs form one to the next. The transition region 53 is a junction region resulting from the welding together of lead-through 51 and outer wire 52, and so typically comprises the cermet material (often Mo and PCA) in lead-through 51 and the wire material in outer wire 52 (often Nb, but other compatible metals could also be used). The PCA in the cermet material typically leaches to the surface of the transition region x during welding so as to give it a somewhat different color appearance compared to cermet lead-through 51 and outer wire 52. In addition, when the PCA leaches to the surface of the transition region, that region becomes a nonconductive surface portion.

Figure 6A:
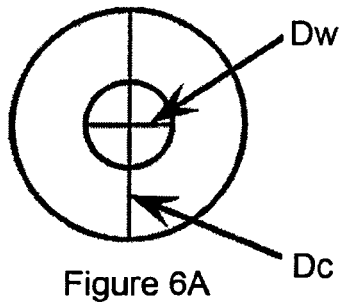
FIG. 6A is a cross section view of a portion of an electrical feedthrough embodying the present invention in a plane perpendicular to that shown in FIG. 6.
Figure 6:
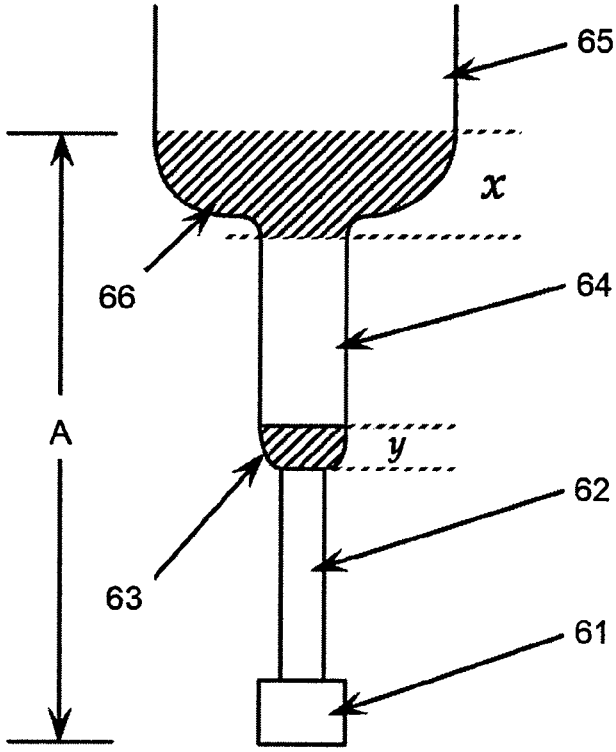
FIG. 6 is a cross section view of a portion of an electrical feedthrough embodying the present invention.

In addition to transition region 53 between the outer wire and the cermet material lead-through in FIG. 5, there is another transition region in the electrical feedthrough marked 63 in FIG. 6 of axial length y in addition to the transition region there marked 66 that corresponds to region 53 in FIG. 5. Here 65 marks the external lead or outer wire; 64 marks the cermet lead-through; 62 marks the W or Mo main electrode shaft; and 61 marks the W electrode coil. The transition region 66 is the result of welding cermet lead-through 64 to main shaft 62. To the degree that the axial lengths x and y of the transition regions 66 and 63 obey the following inequality, the effect on lamp performance is minimized and a narrow distribution of performance variation (<±10% in various lamp operation parameters) can be achieved without difficulty:

$$(2x+2y)<0.1A \qquad \text{Eq. 2}$$

where x is the axial length of transition region 66 and y is the axial length of transition region 63. Here A is the distance from the tip of electrode 61 to the far end of transition region 66 as shown in FIG. 6. In this equation, the coefficient 2 is used in view of the arc length between the feedthrough electrodes being affected by the axial lengths x and y of each the transition regions 66 and 63 in each of the arc tube electrical feedthroughs.

Figure 6B:
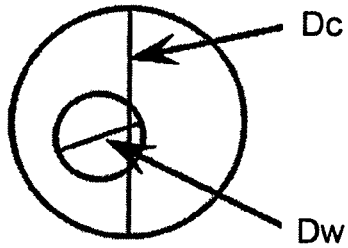
FIG. 6B is a cross section view of a portion of an ineffective electrical feedthrough in a plane perpendicular to that shown in FIG. 6.

Typically, the diameter of the W main shaft 62 is kept smaller than the diameter of cermet lead-through 64. If the diameter of W shaft 62 obeys the following inequalities, $$1.0Dc>Dw>0.5Dc \qquad \text{Eq. 3}$$

where Dc is the diameter of lead-through 64 and Dw is the diameter of the W main shaft 62 in FIGS. 6A and 6B, then the axial extent of transition region 63 need not be taken into consideration since it has a relatively minor effect. The reason is that the transition region 63 becomes smaller and smaller in axial length y as Dw approaches Dc. On the other hand, if Dw is smaller than 0.5 Dc, then the axial length of transition region 63 must obey the inequality of Equation 2 to obtain satisfactory lamp performance results.

Furthermore, under the conditions of Dw<0.5 Dc, the concentricity of W shaft 62 and lead-through 64 becomes important, because, if the situation as shown in FIG. 6B occurs then there is a large opening on one side of W shaft 52. This opening provides a pocket for the salts thereby leading to performance variations. As the size of such a pocket increases, more and more of the salt dispensed into the arc tube starts filling that pocket and thereby acquires the lower temperature of the capillary so as to result in lower vapor pressures and a corresponding lamp performance which is less than optimum.

Figure 6C:
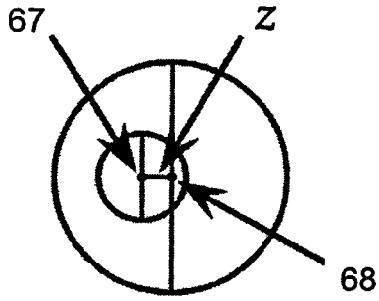
FIG. 6C is a cross section view of a portion of an ineffective electrical feedthrough in a plane perpendicular to that shown in FIG. 6.

Satisfying following concentricity requirement set out in the following inequality $$0\leqq z\leqq 0.25Dw \qquad \text{Eq.3a}$$

in which z is the distance from the center of the W wire to the center of the cermet wire in a plane perpendicular to the axis of the feedthrough (see FIG. 6C) and Dw is again the diameter of the W main shaft results in acceptable lamp performance. In FIG. 6C, 68 is the center of the cermet lead-through and 67 is the center of the W main shaft. Of course, the best result is to have z=0.

Figure 2:
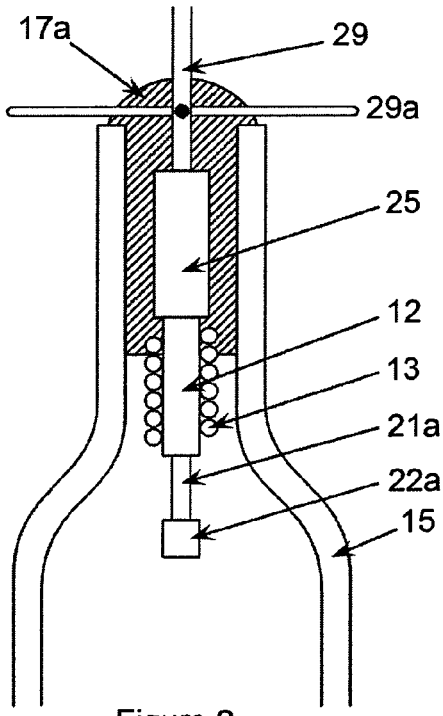
FIG. 2 is a cross section view of an alternative to the portion of FIG. 1A.
Figure 1A:
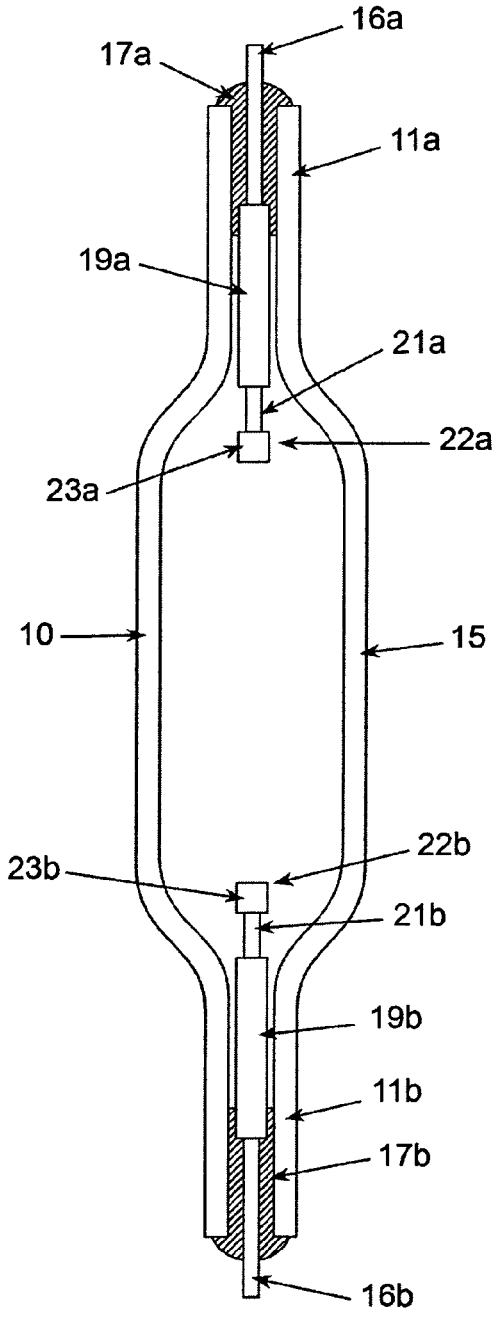
FIG. 1A is a cross section view of a portion of the lamp of FIG. 1.

As indicated above, the region 66 shown in FIG. 6 is usually covered with a layer of alumina ($Al_2O_3$) due to leaching which makes it somewhat difficult to weld other items thereto (for example, if a stopping cross wire like that shown in FIG. 2 is to be provided). Therefore, having a feedthrough step diameter change at transition region 66, because of the diameter of outer wire 65 being greater than that of cermet lead-through 64 so as to also be greater than that of the interior passageway of capillary part 45 in FIG. 4 to thereby provide a stopping point for the insertion of the electrical feedthrough through that passageway into the arc tube, is very convenient for practical manufacturability. Not only is the keeping the Nb outer wire 65 outside the capillary part of the PCA assured, but there is also the advantage of not using manufacturing process time trying to weld a stopping cross wire to an alumina covered surface which would be difficult to accomplish.

The welds in FIGS. 5 and 6 are made by resistance welding. This kind of welding results in a uniform and cylindrically symmetric bond which gives considerable strength to the joint. These joints have the corresponding transition region x, in going from Nb outer wire 65 to cermet lead-through 64, and the corresponding transition region y in going from cermet lead-through 64 to W main shaft 62.

Figure 7:
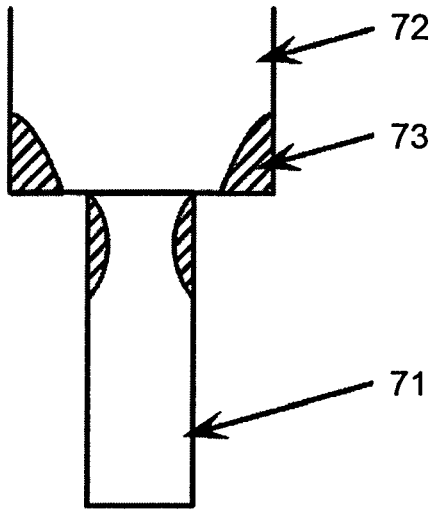
FIG. 7 is a cross section view of a portion of an electrical feedthrough embodying the present invention.

Joints made instead with a few applications of a pulsed laser beam have the appearance shown in FIG. 7 for a typical x transition region joint. Here, 71 marks the cermet lead-through and 72 marks the outer lead wire (which could be of Nb, Ta, or Mo). The hatched regions 73 basically show evaporated material and craters. Such joints are somewhat weaker than the resistance welded joints shown in FIGS. 5 and 6.

Figure 8:
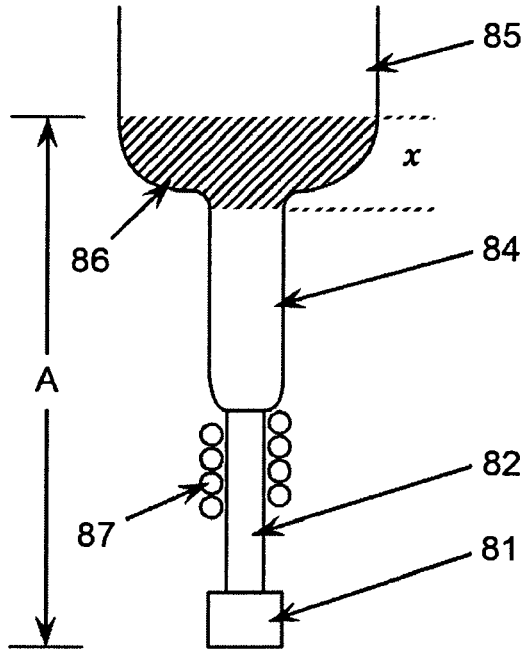
FIG. 8 is a cross section view of a portion of an electrical feedthrough embodying the present invention.
Figure 8A:
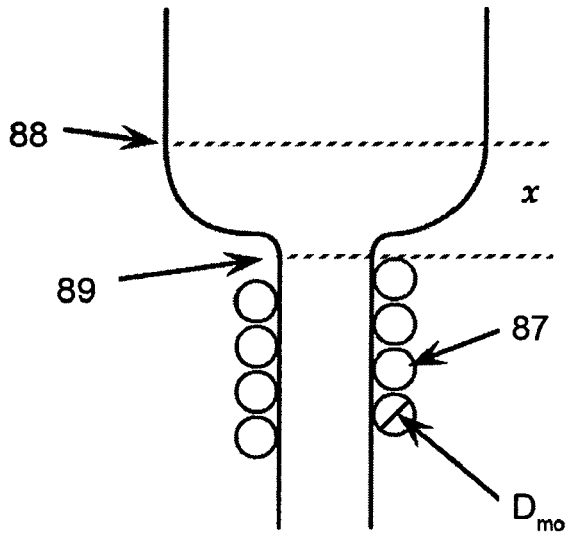
FIG. 8A is a cross section view of a part of the electrical feedthrough portion of FIG. 8.

In FIG. 8, we show the same feedthrough portion arrangement as shown in FIG. 6 except that a Mo coil 87 is added about and at the top of W main shaft 82. Here 84 marks the cermet lead-through, 85 marks the outer lead wire, 82 marks the Mo or W main electrode shaft, and 81 marks the W electrode coil. The distance from the tip of electrode coil 81 to the far end of the transition region x is designated by the letter A. The advantage of Mo coil 87 is, as stated above, to occupy some of the interior volume space in the capillary part so that the salts cannot otherwise be in that same space and thereby become too cooled during lamp operation. Mo coil 87 is shown extending from axial location 89 in FIG. 8A at the near end of transition region y and not from axial location 88 at the far end thereof in that figure (here axial location 88 is an end of the larger diameter cermet lead-through 84). Usually, the sum of twice the Mo coil 87 strand diameter and the W main shaft 82 diameter are very close to the internal diameter (ID) of the capillary part, i.e. within about 10% of the ID of the capillary part. That is, $$2Dmo+Dw\sim0.9Cid \qquad \text{Eq. 4}$$

where Dmo is the diameter of the Mo wire strand, Dw is the diameter of W shaft 82, and Cid is the internal diameter of the PCA capillary. If winding the Mo coil 87 extends from axial location 88, then Eq. 4 is not obeyed and the sum of 2Dmo+Dw becomes greater than Cid to result in the electrode not being able to slide through the opening in the capillary part and so getting stuck therein.

An example arc discharge tube, based on a single body 70 W arc tube having electrical feedthroughs like that shown in FIG. 8, has an outer electrode wire 85 made out of an Nb wire having a diameter of 0.85 mm and a length of 12.0 mm. The cermet lead-through 84 has a 0.7 mm diameter and a length of 6.25 mm. The W electrode main shaft 82 is 0.4 mm in diameter and 2.5 mm long. The Mo coil electrode 87 is 5.5 mm long and the wire has a diameter of 0.15 mm. Each completed feedthrough is inserted into a corresponding capillary part of the arc tube at opposite ends of the main discharge chamber and each has an internal diameter of 0.75 mm. The arc tube is filled with five component rare earth and NaI and T1I salt mixture as well as Hg and a rare gas for starting purposes. The resulting finished arc discharge tube was then mounted in glass envelope 5 of lamp 4 of FIG. 1 in place of tube 10 shown there. The resulting lamp 4 was burned for 100 hours continuously and then measured in an integrating sphere. The performance of the lamp is shown in the following table:

| | |
|---|---|
| Power (W) | 70 |
| Output (Lumen) | 6300 |
| Efficacy (LPW) | 90 |
| Color Temperature (K) | 4012 |
| CRI | 89 |
| Lamp Voltage (V) | 94.7 |

The relative ease of construction of the resulting arc discharge tube compared to that of the alternative approach of inserting a cross wire to a surface covered with alumina and somewhat brittle cermet is striking, and also avoids a considerable yield loss of many electrodes occurring with the cross wire arrangement. The method of constructing electrical feedthroughs of the present invention for CMH lamps is highly accurate and advantageous for a low cost manufacturing operation at high production rates.

Although the present invention has been described with reference to preferred embodiments, workers skilled in the art will recognize that changes may be made in form and detail without departing from the spirit and scope of the invention.

The invention claimed is:

1. An intermediate arrangement for an arc discharge metal halide lamp useable in providing visible light, the lamp comprising:

an arc discharge vessel formed of a visible light transmissive structure which defines a discharge region containing ionizable materials including a metal halide material and which has capillary tubes therein having a selected tube outside width between outside tube surface locations on opposite sides thereof and with a first electrical feedthrough positioned to extend through an interior passageway from a tube outer end in a corresponding one of the capillary tubes to have an interior end of that electrical feedthrough positioned in the discharge region opposite an interior passageway of the other capillary tube and an exterior end thereof positioned outside the outer end of the corresponding capillary tube, the interior passageway thereof having a selected tube inside width between inside interior passageway surface locations on opposite sides thereof; and the first electrical feedthrough having a cermet material portion thereof affixed to an end of an exterior electrical conductor portion thereof along an axis intersecting each that is parallel to the extent of the corresponding capillary tube, and with the exterior electrical conductor portion having a selected exterior conductor outside width between outside exterior electrical conductor surface locations on opposite sides thereof that is less than the tube outside width but greater than the tube inside width, and a bonding material closed loop positioned about the end of the exterior electrical conductor portion such that the bonding material closed loop has no portion thereof extending past the outside tube surface locations of the corresponding capillary tube by more than thirty-five percent of the tube outside width.

2. The lamp of claim 1 wherein the electrical feedthrough has the interior end thereof formed of a metal interior end structure and has the exterior electrical conductor portion formed of a metal exterior end structure with the interior end and exterior end structures being electrically connected to one another at least in part by the cermet material electrically connected therebetween.

3. The lamp of claim 2 wherein the cermet material is positioned entirely within the interior passageway of the capillary tube at or interior to the outer end of that capillary tube and is at least partially covered by resolidified bonding material extending into the interior passageway as are outside tube surface locations after a subsequent melting of the bonding material.

4. The lamp of claim 3 wherein the exterior electrical conductor portion is a niobium rod welded to the cermet material.

5. The lamp of claim 3 wherein the exterior electrical conductor portion is a molybdenum rod welded to the cermet material.

6. An arc discharge metal halide lamp for providing visible light, the lamp comprising:

an arc discharge vessel formed of a visible light transmissive structure which defines a discharge region containing ionizable materials including a metal halide material and which has capillary tubes therein with a first electrical feedthrough positioned to extend through an interior passageway from a tube outer end in a corresponding one of the capillary tubes to have an interior end of that electrical feedthrough positioned in the discharge region opposite an interior passageway of the other capillary tube and an exterior end thereof positioned outside the outer end of the corresponding capillary tube; and the first electrical feedthrough having a cermet material portion thereof, which has a selected cermet outside width between outside cermet material portion surface locations on opposite sides thereof, and that is affixed in an outer fixation joint to an end of an exterior electrical conductor portion thereof along an axis common to, and intersecting, each and that is also affixed in an inner fixation joint to an inner shaft electrical conductor portion along the common axis that also intersects the inner shaft electrical conductor portion, the inner shaft electrical conductor portion of the first electrical feedthrough having a selected inner shaft outside width between outside inner shaft electrical conductor portion surface locations on opposite sides thereof, the outer fixation joint having a length along the common axis between a nearest outside exterior electrical conductor portion surface and a nearest outside cermet material portion surface of a value that, doubled, is less than one-tenth the value of the length between the first fixation joint at the exterior electrical conductor portion side thereof and the interior end of the first electrical feedthrough in the circumstance of the inner shaft outside width having a magnitude with a value between the magnitude of the cermet outside width and one-half that magnitude thereof.

7. The lamp of claim 6 wherein the outer fixation joint has an outer fixation joint length along the common axis between a nearest outside exterior electrical conductor portion surface and a nearest outside cermet material portion surface, and wherein the inner fixation joint has an inner fixation joint length along the common axis between a nearest outside cermet material portion surface and a nearest outside inner shaft electrical conductor portion surface, and wherein the sum of the outer fixation joint length and the inner fixation joint length is of a value that, doubled, is less than one-tenth the value of the length between the first fixation joint at the exterior electrical conductor portion side thereof and the interior end of the first electrical feedthrough in the circumstance of the inner shaft outside width having a magnitude with a value less than one-half that of the cermet outside width.

8. The lamp of claim 6 further comprising a coil of wire that is positioned about the inner shaft electrical conductor portion adjacent the inner fixation joint on the interior end side of the first electrical feedthrough.

9. The lamp of claim 8 wherein the coil of wire is of molybdenum.

10. The lamp of claim 6 wherein the inner shaft electrical conductor portion is a tungsten rod welded to the cermet material.

11. The lamp of claim 6 wherein the inner shaft electrical conductor portion is a molybdenum rod welded to the cermet material.

12. An arc discharge metal halide lamp for providing visible light, the lamp comprising:

an arc discharge vessel formed of a visible light transmissive structure which defines a discharge region containing ionizable materials including a metal halide material and which has capillary tubes therein with a first electrical feedthrough positioned to extend through an interior passageway from a tube outer end in a corresponding one of the capillary tubes to have an interior end of that electrical feedthrough positioned in the discharge region opposite the interior passageway of the other capillary tube and an exterior end thereof positioned outside the outer end of the corresponding capillary tube; and the first electrical feedthrough having a cermet material portion thereof extending along a cermet axis of symmetry with this cermet material portion having a selected cermet outside width between outside cermet material portion surface locations on opposite sides thereof, the cermet material portion being affixed in an inner fixation joint to an inner shaft electrical conductor portion extending along a shaft axis of symmetry substantially parallel to the cermet axis with the inner shaft electrical conductor portion having a selected inner shaft outside width between outside inner shaft electrical conductor portion surface locations on opposite sides thereof, the shaft axis on a corresponding side of the inner fixation joint being offset from the cermet axis on a corresponding side of the inner fixation joint by a distance having a magnitude with a value less than one-quarter that of the inner shaft outside width in the circumstance of the inner shaft outside width having a magnitude with a value less than one-half that of the cermet outside width.

13. The lamp of claim 12 further comprising a coil of wire that is positioned about the inner shaft electrical conductor portion adjacent the inner fixation joint on the interior end side of the first electrical feedthrough.

14. The lamp of claim 13 wherein the coil of wire is of molybdenum.

15. The lamp of claim 12 wherein the inner shaft electrical conductor portion is a tungsten rod welded to the cermet material.

16. The lamp of claim 12 wherein the inner shaft electrical conductor portion is a molybdenum rod welded to the cermet material.

* * * * *